US006604567B1

(12) United States Patent
Woodson et al.

(10) Patent No.: US 6,604,567 B1
(45) Date of Patent: Aug. 12, 2003

(54) FREE RADICALLY CURED COLD-BOX BINDERS CONTAINING AN ALKYL SILICATE

(75) Inventors: Wayne D. Woodson, Georgetown, IL (US); H. Randall Shriver, Columbus, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 10/076,057

(22) Filed: Feb. 14, 2002

(51) Int. Cl.[7] ..... B22D 19/00

(52) U.S. Cl. ..... 164/75; 164/16; 164/138; 164/526; 164/529; 523/139; 523/145; 523/147; 523/436; 523/466

(58) Field of Search ..... 164/16, 138, 526, 164/529, 459, 75; 523/139, 145, 147, 436, 466

(56) References Cited

U.S. PATENT DOCUMENTS

| | | | | |
|---|---|---|---|---|
| 4,358,570 A | * | 11/1982 | Tobinaga | 525/456 |
| 4,518,723 A | | 5/1985 | Woodson | 523/466 |
| 4,526,219 A | | 7/1985 | Dunnavant et al. | 164/16 |

* cited by examiner

*Primary Examiner*—Robert Dawson
*Assistant Examiner*—D. Aylward
(74) *Attorney, Agent, or Firm*—David L. Hedden

(57) ABSTRACT

This invention relates to foundry binder systems, which will cure in the presence of sulfur dioxide and a free radical initiator, comprising (a) an epoxy resin; (b) an acrylate; (c) an alkyl silicate; and (d) an effective amount of a free radical initiator. The foundry binder systems are used for making foundry mixes. The foundry mixes are used to make foundry shapes (such as cores and molds) which are used to make metal castings, particularly ferrous castings.

15 Claims, No Drawings

FREE RADICALLY CURED COLD-BOX BINDERS CONTAINING AN ALKYL SILICATE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to foundry binder systems, which will cure in the presence of sulfur dioxide and a free radical initiator, comprising (a) an epoxy resin; (b) an acrylate; (c) an alkyl silicate; and (d) an effective amount of a free radical initiator. The foundry binder systems are used for making foundry mixes. The foundry mixes are used to make foundry shapes (such as cores and molds) which are used to make metal castings, particularly ferrous castings.

(2) Description of the Related Art

In the foundry industry, one of the procedures used for making metal parts is "sand casting". In sand casting, disposable molds and cores are fabricated with a mixture of sand and an organic or inorganic binder. The foundry shapes are arranged in core/mold assembly, which results in a cavity into which molten metal will be poured. After the molten metal is poured into the assembly of molds and cores and cools, the metal part formed by the process is removed from the assembly. The binder is needed so the molds and cores will not disintegrate when they come into contact with the molten metal.

Two of the prominent fabrication processes used in sand casting are the no-bake and the cold-box processes. In the no-bake process, a liquid curing catalyst is mixed with an aggregate and binder to form a foundry mix before shaping the mixture in a pattern. The foundry mix is shaped by putting it into a pattern and allowing it to cure until it is self-supporting and can be handled. In the cold-box process, a gaseous curing catalyst is passed through a shaped mixture (usually in a corebox) of the aggregate and binder to cure the mixture.

A cold-box process widely used in the foundry industry for making cores and molds is the "$SO_2$ cured epoxy/acrylate system". In this process, a mixture of a hydroperoxide (usually cumene hydroperoxide), an epoxy resin, a multifunctional acrylate, typically a coupling agent, and optional diluents, are mixed into an aggregate (sand) and compacted into a specific shape, typically a core or mold. Sulfur dioxide ($SO_2$), optionally diluted with nitrogen or another inert gas, is blown into the binder/aggregate shape. The shape is instantaneously hardened and can be used immediately in a foundry core/mold system.

This system is currently sold by Ashland Specialty Chemical Division, a Division of Ashland Inc., under the trademark of ISOSET® and has been in use approximately 18 years. About ninety percent of these binders typically use bisphenol-A epoxy resin or bisphenol-F epoxy resin as the epoxy resin component. The multifunctional acrylate most commonly used is trimethylolpropane triacrylate. The hydroperoxide most commonly used is cumene hydroperoxide.

Though the process has been used successfully in many foundries, one of the major weaknesses of the system has been the erosion resistance of foundry shapes made with the binder. Erosion occurs when molten metal contacts the mold or core surfaces during the pouring process and the sand is dislodged at the point of contact. This occurs because the binder does not have sufficient heat resistance to maintain surface integrity until the pouring process is complete. The results is that sand, which has eroded from the foundry shape, is carried into the metal casting, creating weak areas in the casting. A dimensional defect is also created on the surface of the casting.

To correct this problem, foundries have historically resorted to coating the foundry shape with a refractory coating to prevent erosion. Thus, core and mold assemblies are dipped into or sprayed with a slurry composed of a high melting refractory oxide, a carrier such as water or alcohol, and thixotropic additives. When dried on a mold/core surface, the coating very effectively prevents erosion, in most cases. The problem with this approach is that the coating operation is messy, requires expensive gas fired, microwave, or radiant energy ovens to dry the wash onto the core surface. When the core/molds are heated during the drying process the strength of the organic binder to aggregate bond weakens significantly. This results in problems with handling the hot cores and reduction in productivity due to core distortion or cracking. This is especially true with microwave drying.

BRIEF SUMMARY OF THE INVENTION

The subject invention relates to foundry binder systems, which cure in the presence of gaseous sulfur dioxide and a free radical initiator, comprising:

(a) 20 to 70 parts by weight of an epoxy resin;

(b) 5 to 50 parts by weight of an acrylate;

(c) 1 to 20 parts by weight of an alkyl silicate; and (d) an effective amount of a hydroperoxide, where (a), (b), (c), and (d) are separate components or mixed with another of said components, provided (b) is not mixed with (d), and where said parts by weight are based upon 100 parts of binder.

It has been found that addition of the alkyl silicate the binder system results in or molds with enhanced hot tensile strengths, enhanced hot impact resistance, and/or enhanced hot strength properties, which is reflected in improved erosion resistance. These improvements result in better castings and fewer casting defects when the foundry shapes are used to make metal castings. These improvements are even more noticeable if a phenolic resin is added to the binder system.

In particular, foundry shapes made from binders based on epoxy novolac resins, bisphenol-F epoxy resins, or mixtures of bisphenol-F/epoxy novolac resins show enhanced erosion resistance. On the other hand, foundry shapes made with binders based on bisphenol-A epoxy resins exhibit improved hot tensile strength and hot impact resistance, which is particularly significant when the foundry shapes are coated with an aqueous refractory coating and oven-dried.

The foundry binders are used for making foundry mixes. The foundry mixes are used to make foundry shapes, such as cores and molds, which are used to make metal castings.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All percentages are percentages by weight unless otherwise specified.

An epoxy resin is a resin having an epoxide group, i.e.,

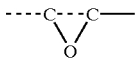

such that the epoxide functionality of the epoxy resin (epoxide groups per molecule) is equal to or greater than 1.9, typically from 2.0 to 4.0.

Examples of epoxy resins include (1) diglycidyl ethers of bisphenol A, B, F, G and H, (2) halogen-substituted aliphatic epoxides and diglycidyl ethers of other bisphenol compounds such as bisphenol A, B, F, G, and H, and (3) epoxy novolacs, which are glycidyl ethers of phenolic-aldehyde novolacs, (4) mixtures thereof.

Epoxy resins (1) are made by reacting epichlorohydrin with the bisphenol compound in the presence of an alkaline catalyst. By controlling the operating conditions and varying the ratio of epichlorohydrin to bisphenol compound, products of different molecular weight can be made. Epoxy resins of the type described above based on various bisphenols are available from a wide variety of commercial sources.

Examples of epoxy resins (2) include halogen-substituted aliphatic epoxides, diglycidyl ethers of other bisphenol compounds such as bisphenol A, B, F, G, and H, and epoxy novolac resins. Examples of halogen-substituted aliphatic epoxides include epichlorohydrin, 4-chloro-1,2-epoxybutane, 5-bromo-1,2-epoxypentane, 6-chloro-1,3-epoxyhexane and the like.

Examples of epoxy novolacs (3) include epoxy cresol and epoxy phenol novolacs, which are produced by reacting a novolac resin (usually formed by the reaction of orthocresol or phenol and formaldehyde) with epichlorohydrin, 4-chloro- 1,2-epoxybutane, 5-bromo-1,2-epoxypentane, 6-chloro-1,3-epoxyhexane and the like.

Preferably used are epoxy resins having an average epoxide functionality of at least 2.1 to 3.5, preferably from about 2.3 to about 3.0. Particularly preferred are epoxy novolacs having an average weight per epoxy group of 165 to 200.

The acrylate is a reactive acrylic monomer, polymer, or mixture thereof and contains ethylenically unsaturated bonds. Examples of such materials include a variety of monofunctional, difunctional, trifunctional, tetrafunctional and pentafunctional monomeric acrylates and methacrylates. A representative listing of these monomers includes alkyl acrylates, acrylated epoxy resins, cyanoalkyl acrylates, alkyl methacrylates, cyanoalkyl methacrylates, and difunctional monomeric acrylates. Other acrylates, which can be used, include trimethylolpropane triacrylate, pentaerythritol tertraacrylate, methacrylic acid and 2-ethylhexyl methacrylate. Typical reactive unsaturated acrylic polymers, which may also be used include epoxy acrylate reaction products, polyester/urethane/acrylate reaction products, acrylated urethane oligomers, polyether acrylates, polyester acrylates, and acrylated epoxy resins.

The alkyl silicates used in the binder may be monomeric or polymeric alkyl silicates. Examples of monomeric alkyl silicates include tetraethyl orthosilicate, tetramethyl orthosilicate, and mixed alkyl silicates. Examples of polymeric alkyl silicates include oligomers of alkyl silicates, such as Dynasil 40, oligomers of alkoxy trialkoxysilanes, oligomers of dialkyl dialkoxysilanes, such as Silbond 40, and oligomers of trialkyl monoalkoxysilanes. Preferably used are tetraethyl orthosilicate and polyethylsilicate. The free radical initiator is a peroxide and/or hydroperoxide. Examples include ketone peroxides, peroxy ester free radical initiators, alkyl oxides, chlorates, perchlorates, and perbenzoates. Preferably, however, the free radical initiator is a hydroperoxide or a mixture of peroxide and hydroperoxide. Hydroperoxides particularly preferred in the invention include t-butyl hydroperoxide, cumene hydroperoxide, paramenthane hydroperoxide, etc. The organic peroxides may be aromatic or alkyl peroxides. Examples of useful diacyl peroxides include benzoyl peroxide, lauroyl peroxide and decanoyl peroxide. Examples of alkyl peroxides include dicumyl peroxide and di-t-butyl peroxide.

Cumene hydroperoxide and/or a multifunctional acrylate, such as trimethylolpropane triacrylate, may be added to the epoxy novolac resin before mixing it with the foundry aggregate. Optionally, a solvent or solvents may be added to reduce system viscosity or impart other properties to the binder system such as humidity resistance. Examples of solvents include aromatic hydrocarbon solvents, such as such as o-cresol, benzene, toluene, xylene, ethylbenzene, alkylated biphenyls and naphthalenes; reactive epoxide diluents, such as glycidyl ether; or an ester solvent, such as dioctyl adipate, esters derived from natural oils, e.g. butyl tallate, rapeseed methyl ester, and the like, or mixtures thereof. If a solvent is used, sufficient solvent should be used so that the resulting viscosity of the epoxy resin component is less than 1,000 centipoise, preferably less than 400 centipoise. Generally, however, the total amount of solvent is used in an amount of 0 to 25 weight percent based upon the total weight of the epoxy resin.

Although solvents are not required for the reactive diluent, they may be used. Typical solvents used are generally polar solvents, such as liquid dialkyl esters, e.g. dialkyl phthalate of the type disclosed in U.S. Pat. No. 3,905,934, and other dialkyl esters such as dimethyl glutarate, dimethyl succinate, dimethyl adipate, and mixtures thereof. Esters of fatty acids, particularly rapeseed methyl ester and butyl tallate, are also useful solvents. Suitable aromatic solvents are benzene, toluene, xylene, ethylbenzene, and mixtures thereof. Preferred aromatic solvents are mixed solvents that have an aromatic content of at least 90% and a boiling point range of 138° C. to 232° C. Suitable aliphatic solvents include kerosene. Although the components can be added to the foundry aggregate separately, it is preferable to package the epoxy novolac resin and free radical initiator as a Part I and add to the foundry aggregate first. Then the ethylenically unsaturated material, as the Part II, either alone or along with some of the epoxy resin, is added to the foundry aggregate.

Phenolic resins may also be used in the foundry binder. Examples include any phenolic resin, which is soluble in the epoxy resin and acrylate, including based catalyzed phenolic resole resins and novolac resins. However, if phenolic resins are used in the binder, typically used are phenolic resole resins known as benzylic ether phenolic resole resins, including alkoxy-modified benzylic ether phenolic resole resins. Benzylic ether phenolic resole resins are prepared by reacting an excess of aldehyde with a phenol in the presence of a divalent metal catalyst. Benzylic ether phenolic resole resins, or alkoxylated versions thereof, are well known in the art, and are specifically described in U.S. Pat. Nos. 3,485,797 and 4,546,124, which are hereby incorporated by reference. These resins contain a preponderance of bridges joining the phenolic nuclei of the polymer, which are ortho-ortho benzylic ether bridges. They are prepared by reacting an aldehyde and a phenol in a mole ratio of aldehyde to phenol of at least 1:1 in the presence of a metal ion catalyst, preferably a divalent metal ion such as zinc, lead, manganese, copper, tin, magnesium, cobalt, calcium, and barium.

It will be apparent to those skilled in the art that other additives such as silanes, silicones, release agents, defoamers, wetting agents, etc. can be added to the aggregate, or foundry mix. The particular additives chosen will depend upon the specific purposes of the formulator.

Typically, the amounts of the components used in the binder system are from 20 to weight percent of epoxy resin, preferably from 35 to 60 weight percent; 5 to 50 weight percent of multifunctional acrylate, preferably from 15 to 35 weight percent; from 1 to 20 parts of alkyl silicate, preferably from 5 to 15 weight percent; from 10 to 25 weight percent of free radical initiator, preferably from 15 to 20 weight percent; and optionally from 2 to 20 parts of phenolic resin, preferably from 6 to 12 weight percent, where the weight percent is based upon 100 parts of the binder system.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used are known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sands, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

The foundry mix is molded into the desired shape by ramming, blowing, or other known foundry core and mold making methods. The shape is then cured almost instantaneously by the cold-box process, using vaporous sulfur dioxide as the curing agent (most typically a blend of nitrogen, as a carrier, and sulfur dioxide containing from 35 weight percent to 65 weight percent sulfur dioxide), described in U.S. Pat. Nos. 4,526,219 and 4,518,723, which are hereby incorporated by reference. The shaped article is preferably exposed to effective catalytic amounts of gaseous sulfur dioxide, and, optionally, minor amounts of a carrier gas can be used. The exposure time of the sand mix to the gas is typically from 0.5 to 10 seconds. The foundry shape is cured after gassing with sulfur dioxide. Oven drying is needed if the foundry shape is coated with a refractory coating.

The core and/or mold may be formed into an assembly. When making castings, the assembly is typically coated with a water-based refractory coating and passed through a conventional or microwave oven to remove the water from the coating. The item is then ready to be handled for further processing.

ABBREVIATIONS

The abbreviations used in the examples are as follows:

| | |
|---|---|
| Bis-A epoxy | bisphenol-A epoxy resin, 1.9 functionality, EEW 184-192, viscosity 13,000 cps @ 25° C. |
| Bis-F epoxy | bisphenol-F epoxy resin, 2.0 functionality, EEW 165-170, viscosity 3,500 cps @ 25° C. |
| CHP | cumene hydroperoxide (9.0% active oxygen). |
| DOA | dioctyl adipate, and ester solvent. |
| EEW | epoxide equivalent weight. |
| EPN 8250 | an epoxy novolac having a functionality of 2.6. |
| EPN 8330 | an epoxy novolac with 3.5 functionality, EEW 170-175, viscosity 500,000 cps @ 25° C. |
| EPS | polyethylsilicate, (Dynasil 40). |
| HI-SOL 15 | aromatic solvent. |
| PR | an 80:20 mixture of (a) a polybenzylic ether phenolic resin having a formaldehyde to phenol mole ratio of 1:2, prepared with zinc acetate dihydrate as the catalyst and modified with the addition of 0.09 mole of methanol per mole of phenol prepared along the lines described in the examples of U.S. Pat. No. 3,485,797, and (b) a dibasic ester solvent. |
| SCA | A-187 epoxy silane coupling agent sold by CK Witco. |
| TEOS | tetraethyl orthosilicate, (Dynasil A). |
| TMPTA | trimethyolpropane triacrylate, an unsaturated monomer. |

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application, all units are in the metric system and all amounts and percentages are by weight, unless otherwise expressly indicated.

The components of the Part I and Part II of the binder were blended for 4 minutes using a Hobart sand mixer. Test cores were prepared by adding 1.0 weight percent of the binder (the Part I was added first) to 3000 grams of Badger 5574 silica sand, such that the ratio of Part I/Part II was 1:1, blowing the mixture at 40 psi, using a Gaylord MTB-3 core blowing unit, gassing it 50% sulfur dioxide in nitrogen for 1.5 seconds, and then purging with air for 10 seconds.

Examples 1–2 illustrate the use of foundry binders based on bisphenol F epoxy resin, while Example 3 illustrates the use of a foundry binder based on bisphenol A epoxy resin.

Measurement of Erosion Resistance

The shape of the erosion wedge and a diagram of the test method are shown in FIG. 7 of "Test Casting Evaluation of Chemical Binder Systems", W L Tordoff et al, AFS Transactions, 80-74, (pages 152–153), developed by the British Steel Casting Research Association, which is hereby incorporated by reference. According to this test, molten iron (1480° C.) is poured through a pouring cup into a 1"

diameter×16 " height sprue, impinges upon the wedge-shaped sand surface at an angle of 60°, to fill a wedge-shaped cavity.

When the mold cavity is filled, pouring is stopped and the specimen is allowed to cool. When cool, the erosion test wedge is removed and the erosion rating determined. If erosion has occurred, it shows up as a protrusion on the slant side of the test wedge.

Resistance to erosion was evaluated based on the results of the tests and the uncoated cores made with the binders. The severity of the erosion is indicated by assigning a numerical rating: 1=Excellent, 2=Good, 3=Fair, 4=Poor, 5=Very poor. This is a very severe erosion test. A rating of 1 or 2 generally implies excellent erosion resistance in actual foundry practice, if the same refractory/binder type and ratio are used. A rating of 3 or higher indicates that a coating is needed. In some tests where erosion is particularly severe, a rating of 5+ may be given, indicating off-scale erosion.

Wedge molds for the erosion wedge casting test were gassed 6.0 seconds with a 50/50 $SO_2$/nitrogen mixture delivered by an MT Systems $SO_2$/Nitrogen blending unit followed by a 30 second dry air purge.

Measurement of Hot Impact Resistance

The impact strength of the coated cores was measured by an "impact penetration test" (AFS test number 324-87-S) and is used to determine differences in core softness when water-based coated sand cores are subjected to drying in a microwave oven. The impact tester used in this test consists of a sharpened-hardened steel probe, graduated in one-centimeter divisions, attached to a hand-operated spring-loaded mechanism for subjecting the probe to a series of hammer blows of equal impact, which was set at a resistance of 18 pounds. The number of blows required to cause a one centimeter penetration of the probe can be related to the softness of a core when it exits a microwave drying oven. A higher number of impacts indicate that the core retains dimensional accuracy and handling properties. The test procedure is described as follows:

(1) In a Hobart mixing bowl, 4000 grams of standard 1L5W grade lake sand are mixed with 1.5% of the binder (Part I and Part II are mixed at a ratio of 1:1). This mixture is mixed at speed #1 for two minutes. After two minutes, sand mix is flipped several times to blend any dry sand at the bottom of the bowl into the sand-binder mix. Then the mixture is mixed for another two minutes.

(2) The sand-binder mix is placed in a core blower sand magazine and the mix is blown (50 PSI) into the rectangular core box (chill wedge), where it is gassed for 2.5 seconds with 50% $SO_2$ in nitrogen (20 PSI) and purged with air for fifteen seconds (40 PSI). The resulting core block (1600–1700 grams in weight) is stripped from the core-box and allowed to set for five minutes.

(3) After aging five minutes, the core block is dipped for three seconds in a water-based foundry coating. The coating used was Ashland Chemical ISOCOTE GCC-1, a water based core coating consisting of a premium grade aluminum silicate, mica, graphite, clay, organic binder, surfactants, and biocide. Excess coating is allowed to drain off for ten seconds. The wet coated core is then place in a standard kitchen microwave (1050 watts on high power). The microwave is turned on and the core is dried for 4.5 minutes.

(4) Immediately upon completion of the drying cycle, the dried core is removed from the oven and the surface temperature is checked with an infrared heat gun (typical temperature is approximately 200° F. after 4.5 minutes).

(5) Once the surface temperature is obtained, the point of the probe of the impact penetration tester is place on the coated surface of the core. Holding the instrument at a right angle to the core surface, the instrument is firmly pressed inwards until a definite impact is felt.[1] The operation is repeated without withdrawing the probe from the surface and the number of impacts necessary to bring the first one-centimeter graduation mark level with the core surface is recorded.[2] Immediately after getting the first impact number, the probe is moved at least one centimeter from initial indentation and the impact test is repeated. The second number of impacts is reported and the average of the two is recorded.

[1]It is important that only the spring loaded hammer in the body of the instrument force the probe into the surface. Therefore, only sufficient pressure should be supplied by the operator to release the hammer mechanism.

[2]Because of the softness of the core coming out of the microwave, the tention of the hammer mechanism is set to the lowest setting by turning the knurled knob counterclockwise to the fully extended postion. At this setting, it requires approxmately 18 pound weight to release the spring loaded hammer mechanism.

Measurement of Hot Tensile Strength

"Dog bone" shaped cores were used to test the tensile strengths of the cores according to AFS test #329-87-S. How well a binder system bonds an aggregrate (sand) together is typically compared using tensile strength measurements and given in pounds per square inch (psi). Sufficient core strength is needed once the binder/sand mix is cured to prevent the core/mold from distorting or cracking during assembly operations. This is especially important when cores/molds are dipped in a refractory coating solution and dried in a conventional or microwave oven. Hot tensile strength measurements are taken immediately after removing the water-based coated tensile test specimens from the drying oven. Binder systems that retain higher hot tensile strengths coming out of a drying oven can better retain their dimensional accuracy and have less core breakage problems.

Comparative Example A (No Alkyl Silicate or Phenolic Resin in the Binder)

A two-part binder system was prepared. To 3000 grams of silica sand, 15 grams of the Part I 15 grams of the Part II were mixed, formed into a test mold, cured and evaluated for erosion resistance as previously described.

| | |
|---|---|
| Part I: | |
| Bis F Epoxy | 52.5% |
| EPN 8330 | 17.5 |
| CHP | 30.0 |
| Part II: | |
| EPN 8250 | 25.0% |
| TMPTA | 50.0 |
| DOA | 18.6 |
| HI SOL-1 | 6.0 |
| SCA | 0.4 |

The core was given an erosion rating of 5+ (Very poor). Hot tensile strength was 25 psi and impact resistance was 38 impacts.

Example 1

(Binder Contains EPS)

In Example 1, the two-part system of Example A was modified by the addition of 8.4% EPS and the reduction of the DOA.

| | |
|---|---|
| Part I: | |
| Bis F Epoxy | 52.5% |
| EPN 8330 | 17.5 |
| CHP | 30.0 |
| Part II: | |
| EPN 8250 | 25.0% |
| TMPTA | 50.0 |
| DOA | 10.2 |
| EPS (Dynasil 40) | 8.4 |
| HI SOL-15 | 6.0 |
| SCA | 0.4 |

This core was given an erosion rating of 2.5 (Fair), which was a significant improvement over the core made with the binder that did not contain EPS. Hot tensile strength was 29 psi and impact resistance was 47 impacts.

Comparative Example B (Binder Contains Phenolic Resin, but does not Contain Alkyl Silicate)

A two-part binder system was prepared similar to Control A, except it contained a phenolic resin in the Part II.

| | |
|---|---|
| Part I: | |
| Bis F Epoxy | 52.5% |
| EPN 8330 | 17.5 |
| CHP | 30.0 |
| Part II: | |
| Bis A Epoxy | 22.4% |
| TMPTA | 44.8 |
| PR | 23.8 |
| DOA | 6.3 |
| HI SOL 15 | 2.1 |
| SCA | 0.6 |

The core was given an erosion rating of 2.5 (Fair). Hot tensile strength was 24 psi and the impact resistance was 14 impacts.

Example 2

(Binder Contains Phenolic Resin and an Alkyl Silicate)

The two-part binder system from Example B was modified by the addition of 18.4% EPS, the elimination of DOA and HI-SOL 15, and the reduction of the epoxy resin and phenolic resin in the Part II.

| | |
|---|---|
| Part I: | |
| Bis F Epoxy | 52.5% |
| EPN 8330 | 17.5 |

-continued

| | |
|---|---|
| CHP | 30.0 |
| Part II: | |
| Bis A Epoxy | 20.0% |
| TMPTA | 44.8 |
| PR | 21.2 |
| EPS | 18.4 |
| SCA | 0.6 |

The core prepared with this binder had an erosion rating of 1.5 (Excellent), which is a significant improvement over the core prepared from the binder of Example B that did not contain EPS. This core showed the better erosion resistance than the core prepared with the binder containing EPS, but without a phenolic resin. Hot tensile strength was 46 psi and the impact resistance was 26.5 impacts.

Examples A and 1 illustrate the effect of adding EPS to binder that does not contain a phenolic resin. Examples B and 2 illustrate the effect of adding EPS to a binder that also contains a phenolic resin. The results indicate that the addition of the EPS improves the erosion resistance of castings made with both binders, although the binder containing the phenolic resin showed the most improvement. This improvement is sufficient, in some instances, to enable the foundry to use cores that are not coated with a refractory coating.

Comparison Example C (Binder Based on Bis A Epoxy Resin and no Alkyl Silicate)

A two-part binder system was prepared. To 3000 grams of lake sand, 19.5 grams of 4304 and 19.5 grams of 4305NS were mixed. Tensile test specimens were gassed 1.5 seconds with a 50/50 $SO_2$/nitrogen mixture delivered by an MT Systems $SO_2$/Nitrogen blending unit followed by a 10 second dry air purge. A set of three test specimens were then aged five minutes before dipping three seconds into a water-based refractory coating. Next they were placed in a 350° F. conventional oven and allowed to dry for 15 minutes. Tensile strengths of the dried cores were measured immediately upon removal from the oven.

| | |
|---|---|
| Part I. | |
| Bis A Epoxy | 65.0% |
| CHP | 35.0 |
| Part II. | |
| Bis A Epoxy | 53.7% |
| TMPTA | 45.7 |
| SCA | 0.6 |

Hot strength properties of this type of binder (Bis-A epoxy) require the use of refractory coating. Erosion wedge casting tests as described above typically receive erosion rating of 5+ (very poor). Standard tensile test specimens were prepared using Part I/Part II ratio of 50/50. The hot tensile strengths of three test specimens of this sand/binder mix averaged 25 psi.

Example 3

(Binder Based on Bis A Epoxy Resin Alkyl Silicate)

A two-part binder system was prepared as in Example C, except EPS was added to the binder system.

| | |
|---|---|
| Part I: | |
| Bis A Epoxy | 65.0% |
| CHP | 35.0 |
| Part II: | |
| Bis A Epoxy | 43.7% |
| TMPTA | 45.7 |
| EPS | 10.0 |
| SCA | 0.6 |

The hot tensile strengths of three test cores prepared with this binder averaged 36 psi., which amounts to an increase of 44% over the core made with the binder that did not contain EPS.

Examples C and 3 illustrate the effect of modifying a commercial bis-A epoxy system with EPS. The tests show that the hot tensile strength is improved by over 40% when the EPS is added. Because foundries typically have to use a refractory coating when cores are made with a binder based on Bis-A epoxy, improving the hot tensile strength properties would decrease the incidence of cracked or distorted cores.

In addition to the hot tensile strength tests on the cores made in Examples C and 3, measurements were made comparing the hot impact resistance of the cores. This test was developed in response to the increase use of microwave drying of water based refractory coated cores and molds. Microwave drying operations place a heavier demand on the organic binder systems. The cores and molds are exposed to drying temperatures for a shorter length of time, typically five minutes or less, so any post-curing which may occur in a conventional oven does not have time to take place. The heating is also very uneven so the surface temperature may vary as much as 50° C. Poorer airflow in industrial microwave drying ovens creates an atmosphere saturated with moisture and cores/molds emerge from the oven are not completely dry. This entrained hot moisture is very detriment to the strength of any organic binder. Bis-A epoxy based binders similar to Example C emerge from the oven extremely soft and incapable of being handled immediately without damaging the core or mold. Cooling times of 45–60 minutes are required before they may be handled an unacceptable condition for most foundries.

The impact penetration test measures the core softness after microwave drying. A core was prepared with the binder described in Example C. An approximately 1650-gram chill wedge core was prepared, cured, and removed from the wooden core box. After aging the core for 5 minutes it was dipped three seconds into the water-based refractory coating and immediately placed in a standard kitchen microwave oven (1050W on high power). Drying time was 4.5 minutes and immediately upon removal the impact tester was use to determine the number of impacts needed for the probe to reach a depth of one centimeter. Two tests were run on one of the coated sides of the core whose surface temperatures were approximately 95° C. These impact tests were then repeated on a second chill wedge core. The cured core in Example C averaged 16.5 impacts, which indicated that the core was very soft and would require a lengthy cool down time before it could be safely handled.

A core was also prepared with the binder of Example 3 and the impact resistance test was conducted. The cured core of Example 3 averaged 52.5 impacts, which indicated that the core was hard and cured, and could be readily handled without breaking. This improvement in core hardness permits cores to be handled much sooner, thereby improving the overall productivity.

The data generated by the tests is summarized in Table I that follows:

TABLE I

| Example | Hot tensile/psi | Hot impact # | Erosion resistance |
|---|---|---|---|
| A | 25 | 38 | 5+ |
| 1 | 29 | 47 | 2.5 |
| B | 24 | 14 | 2.5 |
| 2 | 46 | 26.5 | 1.5 |
| C | 25 | 16.5 | 5+ |
| 3 | 36 | 53 | 5+ |

The data in Table I indicate that the addition of EPS to the binder formulation improves hot tensile strengths and/or erosion resistance. Both benefits are achieved when a bisphenol F epoxy resin is used.

We claim:

1. A foundry binder system, which will cure in the presence of sulfur dioxide and a free radical initiator, comprising:

(a) 20 to 70 parts by weight of an epoxy resin;

(b) 5 to 50 parts by weight of an acrylate;

(c) 1 to 20 of an alkyl silicate; and (d) an effective amount of a peroxide, wherein (a), (b), and (c) are separate components or mixed with another of said components, provided (b) is not mixed with (d), and where said parts by weight are based upon 100 parts of binder.

2. The binder system of claim 1 wherein the wherein the epoxy resin is selected from the group consisting of epoxy resins derived from bisphenol A, epoxy resins derived from bisphenol F, epoxidized novolac resins, and mixtures thereof.

3. The foundry binder system of claim 2 which further comprises a phenolic resin.

4. The foundry binder system of claim 3 wherein the alkyl silicate is selected from the group consisting of tetraethyl orthosilicate, ethylpolysilicate, and mixtures thereof.

5. The binder system of claim 4 wherein the epoxy resin has an epoxide equivalent weight of about 165 to about 225.

6. The binder system of claim 5 wherein the acrylate is a monomer and the monomer is trimethyolpropane triacrylate and the peroxide is a hydroperoxide.

7. The binder system of claim 6 wherein the hydroperoxide is cumene hydroperoxide.

8. The foundry binder system of claim 7 wherein the amount of epoxy resin is from 20 to 70 weight percent; the amount of multifunctional acrylate is from 5 to 50 weight percent; the amount of alkyl silicate is from 1 to 20 weight percent; the amount of free radical initiator is from 10 to 25 weight percent; and the amount of phenolic resin is from 2 to 20 weight percent, where the weight percent is based upon 100 parts of the binder system.

9. A foundry mix comprising:

(a) a major amount of foundry aggregate;

(b) an effective bonding amount of the foundry binder system of claim 1, 2, 3, 4, 5, 6, 7, or 8.

10. A cold-box process for preparing a foundry shape comprising:

(a) introducing the foundry mix of claim 9 into a pattern; and (b) curing with gaseous sulfur dioxide.

11. A foundry shape prepared in accordance with claim 10.

12. A process of casting a metal article comprising:

(a) fabricating an uncoated foundry shape in accordance with claim 11;

(b) pouring said metal while in the liquid state into said coated foundry shape;

(c) allowing said metal to cool and solidify; and (d) then separating the molded article.

13. The process of claim 12 wherein the foundry shape of step (a) is coated.

14. A casting prepared in accordance with claim 13.

15. A casting prepared in accordance with claim 14.

* * * * *

UNITED STATES PATENT AND TRADEMARK OFFICE

CERTIFICATE OF CORRECTION

PATENT NO. : 6,604,567 B1 
DATED : August 12, 2003
INVENTOR(S) : Wayne D. Woodson and H. Randall Shriver It is certified that error appears in the above-identified patent and that said Letters Patent is hereby corrected as shown below:

Column 12,
Line 31, insert -- parts -- after "20".

Signed and Sealed this

First Day of February, 2005

JON W. DUDAS
*Director of the United States Patent and Trademark Office*